US011378291B2

(12) United States Patent
Huang

(10) Patent No.: US 11,378,291 B2
(45) Date of Patent: Jul. 5, 2022

(54) CLEAN ROOM AND METHOD FOR REGULATING AIRFLOW OF CLEAN ROOM

(71) Applicants: HKC CORPORATION LIMITED, Shenzhen (CN); CHONGQING HKC OPTOELECTRONICS TECHNOLOGY CO., LTD., Ba'nan District (CN)

(72) Inventor: Chunchin Huang, Shenzhen (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 669 days.

(21) Appl. No.: 16/312,749

(22) PCT Filed: May 27, 2017

(86) PCT No.: PCT/CN2017/086261
§ 371 (c)(1),
(2) Date: Dec. 21, 2018

(87) PCT Pub. No.: WO2018/103279
PCT Pub. Date: Jun. 14, 2018

(65) Prior Publication Data

US 2019/0338967 A1 Nov. 7, 2019

(30) Foreign Application Priority Data

Dec. 6, 2016 (CN) ..... 201611109857.2

(51) Int. Cl.
*F24F 3/167* (2021.01)
*F24F 11/89* (2018.01)
(Continued)

(52) U.S. Cl.
CPC ..... *F24F 3/167* (2021.01); *F24F 7/007* (2013.01); *F24F 11/0001* (2013.01);
(Continued)

(58) Field of Classification Search
CPC ..... F24F 13/167; F24F 13/163; F24F 7/10; F24F 11/89; F24F 3/161
(Continued)

(56) References Cited

U.S. PATENT DOCUMENTS 5,207,614 A * 5/1993 Passadore ..... F24F 13/12 137/625.3
2002/0108334 A1* 8/2002 Rapisarda ..... F24F 3/167 52/302.1
2017/0004985 A1* 1/2017 Nishi ..... H01L 21/67173

FOREIGN PATENT DOCUMENTS

CN 1119040 A 3/1996
CN 1220615 A 6/1999
(Continued)

OTHER PUBLICATIONS

International Search Report dated Aug. 30, 2017 in corresponding International Application No. PCT/CN2017/086261; 6 pages.
(Continued)

*Primary Examiner* — Vivek K Shirsat
(74) *Attorney, Agent, or Firm* — Westbridge IP LLC

(57) ABSTRACT

A clean room and a method for regulating an airflow of the clean room. The clean room includes: a plurality of process spaces in communication with one another, and a fan filter unit. The fan filter units is installed at a top of each one of the plurality of process spaces, and a bottom of each of the plurality of process spaces is provided with a ventilation passage. The clean room further includes: an airflow regulation device, configured to regulate an airflow in each of the process spaces; the airflow regulation device is installed
(Continued)

inside each of the plurality of process spaces, and is arranged downstream of the respective fan filter unit.

17 Claims, 5 Drawing Sheets

(51) Int. Cl.

| | |
|---|---|
| ***F24F 7/007*** | (2006.01) |
| ***F24F 11/00*** | (2018.01) |
| ***F24F 13/08*** | (2006.01) |
| ***F24F 13/28*** | (2006.01) |

(52) U.S. Cl.
CPC ..... *F24F 11/89* (2018.01); *F24F 13/082* (2013.01); *F24F 13/28* (2013.01)

(58) Field of Classification Search
USPC ..... 454/187, 184, 255, 296–298, 324
See application file for complete search history.

(56) References Cited

FOREIGN PATENT DOCUMENTS

| | | | |
|---|---|---|---|
| CN | 1270539 | A | 10/2000 |
| CN | 1360178 | A | 7/2002 |
| CN | 1401949 | A | 3/2003 |
| CN | 101089502 | A | 12/2007 |
| CN | 101967893 | A | 2/2011 |
| CN | 202899553 | U | 4/2013 |
| CN | 203163096 | U | 8/2013 |
| CN | 106556085 | A | 4/2017 |
| JP | S6020030 | A | 2/1985 |
| JP | S61197927 | A | 9/1986 |
| JP | H05-172378 | A | 7/1993 |

OTHER PUBLICATIONS

First Office Action in counterpart Chinese Application No. 201611109857.2, dated Oct. 22, 2018.

* cited by examiner

CLEAN ROOM AND METHOD FOR REGULATING AIRFLOW OF CLEAN ROOM

CROSS-REFERENCE TO RELATED APPLICATIONS

This application is the U.S. national phase of International Application No. PCT/CN2017/086261 with an international filing date of May 27, 2017, designating the U.S., now pending, and further claims priority benefits to Chinese Patent Application No. 201611109857.2 filed Dec. 6, 2016. The contents of all of the aforementioned applications, including any intervening amendments thereto, are incorporated herein by reference.

BACKGROUND

Technical Field

The present application relates to the technical field of dust-free clean environment technology, and more particularly to a clean room and a method for regulating an airflow of the clean room.

Description of Related Art

An area with process cleanliness, i. e., a clean room, adopts a Fan Filter Unit (FFU) to regulate the ventilation frequency in a process space to achieve the required cleanliness (for example, cleanliness class 100, i. e., Class 100 of the clean room). During the regulation of the airflow in the process space, the rotational speed of the FFU is regulated according to requirements on Down Flows of structures of different devices.

When the structures of devices are complicated and the main process area (i. e., the clean room area where the process production operation is performed) needs to maintain a positive pressure, the FFU can only be regulated by regional control. If the demand for maintaining the positive pressure in the main process area is still not achieved, a regional ventilation space is required to be sealed, but such regulation is laborious and the regulation effect achieved after the regulation is not good.

In addition, in the initial stage of equipment installation in the clean room, if the clean function of a semiconductor fabrication plant (FAB, clean room) has not been completed yet, the dust-free space environment (cleanliness class of the clean room is required to achieve Class 100) of the main process clean area is vulnerable to the air pollution from the space of a non-process area (cleanliness class of the clean room is Class 100), which results in decrease in the cleanliness class of the clean room of the main process clean area, and further requires to improve the cleaning frequency of the FFU, which is time-consuming and laborious and would result in serious consequence of affecting the subsequent product yield.

BRIEF SUMMARY

It is an object of the present application to provide a clean room and a method for regulating an airflow of the clean room, which aims at solving the problem that in the existing clean room, the airflow regulation in the dust-free clean room environment is based on the fan filter unit, which is time-consuming and laborious and would result in serious consequence of affecting the subsequent product yield.

In order to solve the above technical problem, the present application adopts the following technical solution: a clean room is provided and the clean room comprises: a plurality of process spaces in communication with one another, and a fan filter unit. The fan filter unit is installed at a top of each one of the plurality of process spaces, and a bottom of each one of the plurality of process spaces is provided with a ventilation passage. The clean room further comprises: an airflow regulation device, configured to regulate an airflow in each of the process spaces; the airflow regulation device is installed inside each of the plurality of process spaces, and is arranged downstream of the respective fan filter unit.

In one embodiment, the airflow regulation device is installed close to the bottom of the respective process space above the ventilation passage.

In one embodiment, an airflow exchange passage is arranged between two adjacent process spaces; the airflow regulation device is installed close to the bottom of the respective process space, and the airflow regulation device is arranged between the ventilation passage and the airflow exchange passage.

In one embodiment, the airflow exchange passage between the two adjacent process spaces is provided therein with the airflow regulation device.

In one embodiment, a distance between the airflow regulation device and a bottom surface of the respective process space is H, and 20 cm≤H≤35 cm.

In one embodiment, the airflow regulation device comprises a first perforated plate and a second perforated plate. The first perforated plate and the second perforated plate are stacked with each other, and the first perforated plate and the second perforated plate are in surface contact with each other. The first perforated plate and the second perforated plate respectively define therein airflow channels, when the first perforated plate and the second perforated plate are stacked with each other, the airflow channels of the first perforated plate and the airflow channels of the second perforated plate at least partially align or misalign with each other.

In one embodiment, the first perforated plate further defines therein a plurality of first regulation holes, the second perforated plate further defines therein a plurality of second regulation holes, each of the first regulation holes and each of the second regulation holes are arranged in one-to-one correspondence, and each of the first regulation holes and the corresponding second regulation hole are connected via an adjustable connection.

In one embodiment, the adjustable connection is provided by a combination of a bolt and a nut fitting with each other.

In one embodiment, the first perforated plate is fixed relative to the bottom of each process space. The second perforated plate is arranged slidable relative to the first perforated plate via the adjustable connection. The adjustable connection comprises: a controller, and a driving motor. A driving end of the driving motor is in driving connection with the second perforated plate, and the driving motor is in electrical connection with the controller.

In one embodiment, the adjustable connection further comprises a driving screw. One end of the driving screw is in driving connection with the driving end of the driving motor, and the other end of the driving screw is in connection with the second perforated plate. The second perforated plate defines therein a threaded hole, and the driving screw is fitted inside the threaded hole.

In one embodiment, the adjustable connection further comprises a driving screw and a driving nut. The driving nut is in fixed connection with the second perforated plate, one end of the driving screw is in driving connection with the driving end of the driving motor, and the other end of the driving screw extends through and fits with the driving nut.

In one embodiment, balls are disposed between the driving screw and the driving nut to form a ball screw.

In one embodiment, contact surfaces between the first perforated plate and the second perforated plate are respectively provided with wear resistant layers.

In one embodiment, the airflow regulation device comprises: a first perforated plate, a second perforated plate, and a third perforated plate which are sequentially stacked. The second perforated plate and the first perforated plate are in surface contact with each other, and the second perforated plate and the third perforated plate are in surface contact with each other. Each of the first perforated plate, the second perforated plate, and the third perforated plate defines therein a plurality of airflow channels. The airflow channels of the first perforated plate and the airflow channels of the third perforated plate are arranged in one-to-one correspondence, one end of each of the airflow channels of the second perforated plate and the corresponding airflow channel of the first perforated plate at least partially align with each other or misalign with each other, and the other end of each of the airflow channels of the second perforated plate and the corresponding airflow channel of the third perforated plate at least partially align with each other or misalign with each other.

In one embodiment, the first perforated plate further defines therein a plurality of first perforated plate connecting holes, the third perforated plate further defines therein a plurality of third perforated plate connecting holes; each of the first perforated plate connecting holes is arranged to be aligned with each of the third perforated plate connecting holes. The second perforated plate further defines therein a plurality of second perforated plate regulation holes. A bolt is connected inside each of the second perforated plate regulation holes and a corresponding first perforated plate connecting hole and third perforated plate connecting hole, and each of the second perforated plate regulation holes and the corresponding first perforated plate connecting hole and third perforated plate connecting hole are tightened by threaded fit of the bot with a nut.

In one embodiment, both the first perforated plate and the third perforated plate are fixed relative to the bottom of the process space. The second perforated plate is arranged to be slidable relative to the first perforated plate and the third perforated plate via the adjustable connection. The adjustable connection comprises: a controller and a driving motor. A driving end of the driving motor is in driving connection with the second perforated plate, and the driving motor is in electrical connection with the controller.

In one embodiment, the adjustable connection further comprises a driving screw. One end of the driving screw is in driving connection with the driving end of the driving motor, and the other end of the driving screw is in connection with the second perforated plate. The second perforated plate defines therein a threaded hole, and the driving screw is fitted inside the threaded hole.

In one embodiment, contact surfaces between the first perforated plate and the second perforated plate are provided with wear resistant layers, and contact surfaces between the second perforated plate and the third perforated plate are provided with wear resistant layers.

According to another aspect of the present application, a method for regulating an airflow of a clean room is provide. The method is performed in the above-described clean room, and the method comprises the following steps:

powering on the fan filter unit of the respective clean room for supplying air; and controlling the airflow into the process spaces of the clean room by regulation of the airflow regulation device of the respective clean room.

In one embodiment, the airflow regulation device comprises a plurality of perforated plates being stacked with one another; each perforated plate defines therein a plurality of airflow channels. In the step of controlling the airflow into the process spaces of the clean room by regulation of the airflow regulation device of the respective clean room, a flow rate of the airflow within the respective process space is controlled by regulating the airflow channels of different perforated plates in one-to-one correspondence to partially align or misalign with each other.

When applying the clean room of the present application, compared to the existing clean room, it is not necessary to regulate the air supply state by frequently regulating the fan filter unit in order to maintain the positive pressure in the process space. It only requires to regulate the airflow regulation device to realize the control and regulation of the air supply state, which is simple and convenient. Moreover, the process space that has not yet been fully cleaned can be effectively partitioned, thus ensuring that the process space undergoing the production is prevented from pollution.

DETAILED DESCRIPTION OF THE DRAWINGS

DETAILED DESCRIPTION OF THE EMBODIMENTS

In order to make the objects, technical solutions, and advantages of the present application more clear, the present application will be further described in detail hereinbelow with reference to the accompanying drawings and embodiments. It should be understood that the specific embodiments described herein are merely intended to explain the application rather than to limit the present application.

It should be noted that when an element is referred to as being "fixed" or "arranged" at/in/on another element, it can be directly or indirectly at/in/on the other element. When an element is referred to as being "connected" to/with another element, it can be directly or indirectly connected to/with the other element.

It should also be noted that the terms of the left, right, upper, and lower orientations in these embodiments are merely relative concepts or reference to the normal use state of the product, and should not be considered as limitation.

Figure 1:
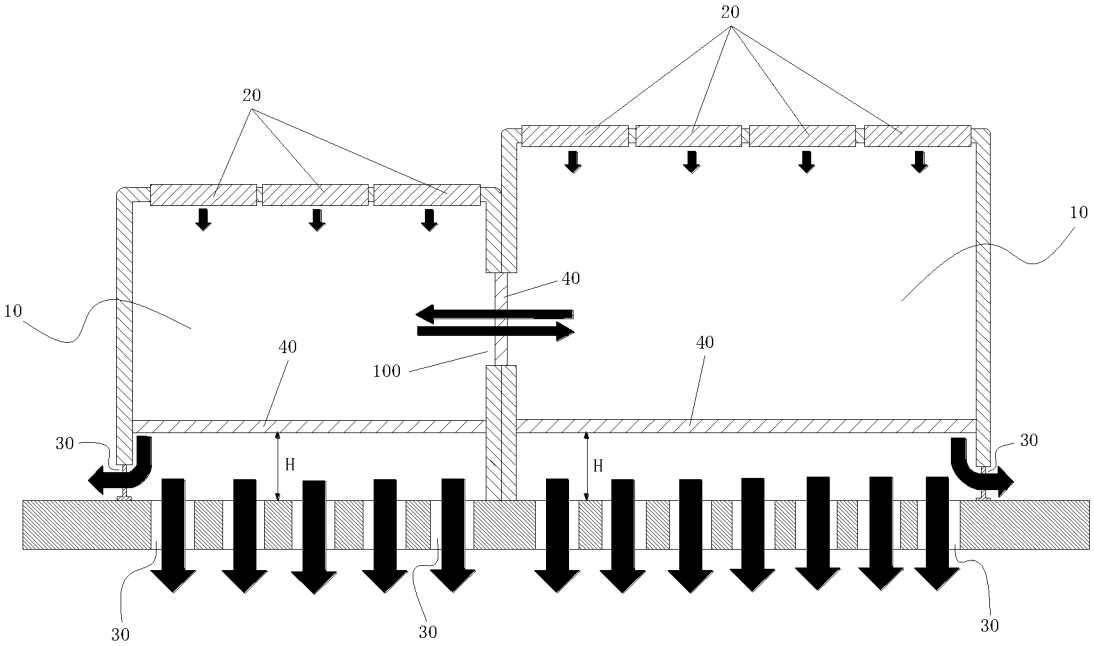
FIG. 1 is a cross-sectional structural schematic view of a clean room of the present application.

As shown in FIG. 1, a clean room provided by a first embodiment of the present application comprises: a plurality of process spaces 10, a plurality of fan filter units 20, and airflow regulation devices 40. The plurality of process spaces 10 communicate with one another, each fan filter unit 20 is installed at a top of each process space 10, and a bottom of each process space 10 is provided with a ventilation passage 30. Each airflow regulation device 40 is configured to regulate the airflow in each process space 10. Each airflow regulation device 40 is installed within each process space 10, and each airflow regulation device 40 is arranged downstream of a corresponding fan filter unit 20.

The fan filter unit 20 is adopted to supply air into the process space 10, and airflow is generated between the fan filter unit 20 and the ventilation passage 30 in the process space 10. When clean air is introduced via the fan filter unit 20, the airflow regulation device 40 is configured to regulate the flow rate and supply volume of the airflow and the clean air is eventually introduced into the process space 10, such that the air pressure state within the process space 10 is regulated to maintain a positive pressure within the process space 10 (the positive pressure is relative to the air pressure outside the process space, the air pressure in the process space 10 that is larger than that of the external environment is referred to as the positive pressure, while the air pressure within the process space 10 that may be smaller than that of the external environment is referred to as a negative pressure). Compared with the existing clean room, the clean room of the present application does not need to frequently regulate the fan filter unit 20 to regulate the state of the air supply to keep the positive pressure in the process space 10, it only needs to regulate the airflow regulation device 40 to realize the control and regulation of the state of the air supply, which is convenient and fast. Moreover, the process space 10 that has not yet been fully cleaned can be effectively partitioned, thus ensuring that the process space 10 undergoing the production is prevented from pollution.

In one embodiment, the airflow regulation device 40 is installed closed to a bottom of the process space 10 above the ventilation passage 30. In this way, air from the external is filtered and cleaned by the fan filter unit 20, and blown into the process space 10, after the flow rate and flow volume of the airflow are regulated by the airflow regulation device 40, the airflow is introduced out via the ventilation passage 30 at the bottom of the process space 10. As shown in FIG. 1, the airflow regulation device 40 after installation thereof forms a floor of the process space 10, and a distance between the airflow regulation device 40 and a bottom surface of the process space 10 is H, for example 20 cm≤H≤35 cm. In some embodiments, for example, 25 cm≤H≤30 cm.

In this embodiment, an airflow exchange passage 100 is arranged between two adjacent process spaces 10, such that it is convenient for the airflow exchange among the process spaces 10, and thereby a communicating airflow exchange space is formed among the process spaces 10. In such case, the airflow regulation device 40 is installed close to the bottom of the process space 10, and the airflow regulation device 40 is arranged between the ventilation passage 30 and the airflow exchange passage 100. Air exchange between two adjacent process spaces 10 can be performed via the airflow exchange passage 100, such that the two adjacent process spaces 10 can maintain the same air cleanliness, and the air pressures in the two adjacent process spaces 10 are maintained to be consistent.

The airflow exchange passage 100 between two adjacent process spaces 10 is also installed with the airflow regulation device 40. In this way, although the assemblage progress of the devices with cleanliness functions in different process spaces may be different, based on the airflow regulation device 40 installed in the airflow exchange passage 100 between two adjacent the process spaces 10, it is only required to regulate the airflow regulation device 40 to an airflow blocking work mode, so as to block the airflow exchange between two adjacent process spaces 10, such that the process space 10 that has not fully completed its cleanliness function yet is prevented from polluting the cleanliness class of the process space 10 that has completed the cleanliness function.

Figure 2:
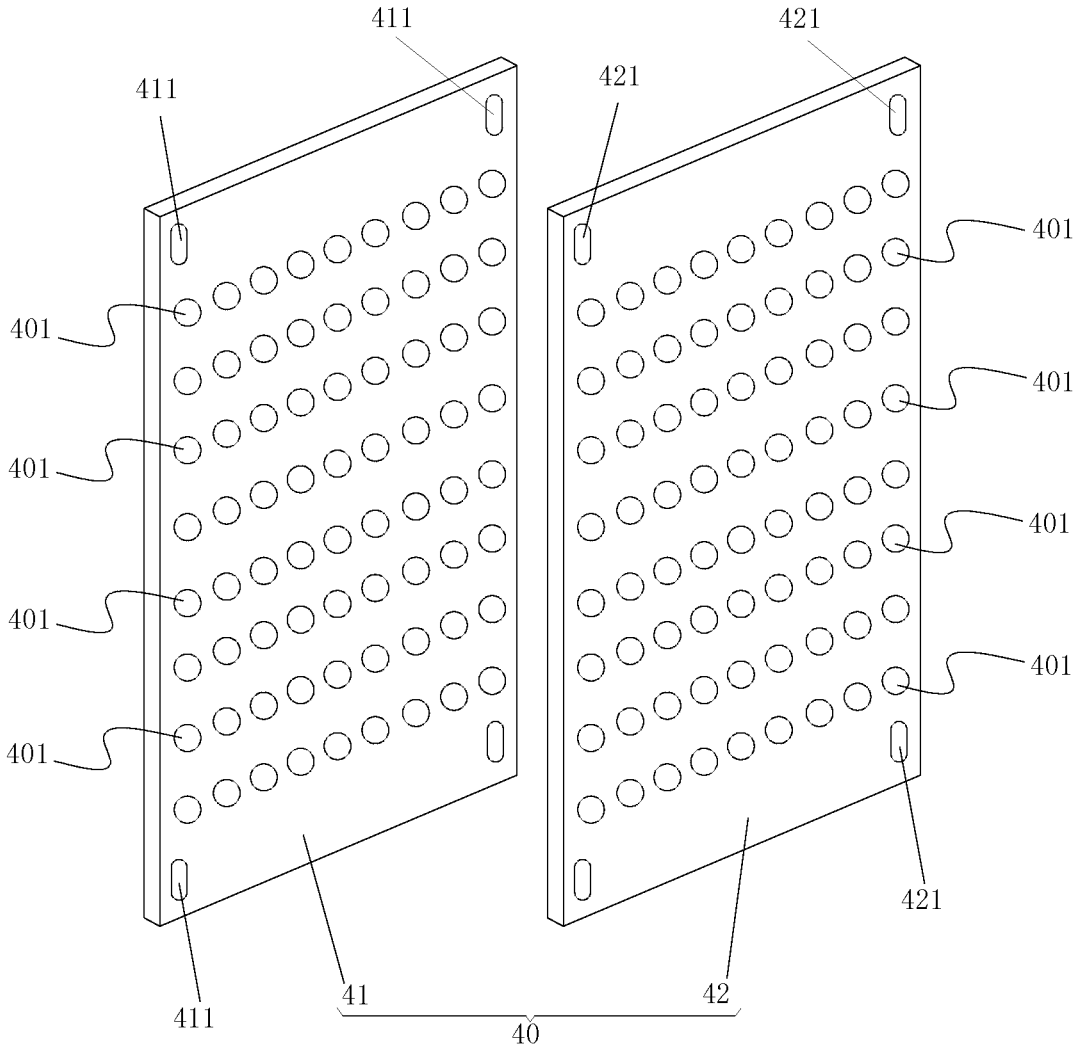
FIG. 2 is an exploded structural schematic view of an airflow regulation device of a first embodiment of the present application.

As shown in FIG. 2, the airflow regulation device 40 of the first embodiment comprises a first perforated plate 41 and a second perforated plate 42. The first perforated plate 41 and the second perforated plate 42 are stacked with each other, the first perforated plate 41 and the second perforated plate 42 are in surface contact with each other, and the first perforated plate 41 and the second perforated plate 42 are is arranged slidable relative to each other for regulation. The first perforated plate 41 and the second perforated plate 42 respectively define therein airflow channels 401, when the first perforated plate 41 and the second perforated plate 42 are stacked with each other, the airflow channels 401 of the first perforated plate 41 and the airflow channels 401 of the second perforated plate 42 at least partially align or misalign with each other. When the airflow channels 401 of the first perforated plate 41 and the airflow channels 401 of the second perforated plate 42 completely coincide, the flow volume of the airflow passing through the airflow regulation device 40 is maximum. When the airflow channels 401 of the first perforated plate 41 and the airflow channels 401 of the second perforated plate 42 are completed staggered relative to one another, the airflow is blocked by the airflow regulation device 40 and cannot pass therethrough (that is, the airflow blocking work mode). When the airflow channels 401 of the first perforated plate 4 and the airflow channels 401 of the second perforated plate 42 partially coincide, by regulating the alignment degree between the airflow channels 401 of the first perforated plate 41 and the airflow channels 401 of the second perforated plate 42, the flow rate and flow volume of the airflow passing the airflow regulation device 40 can be controlled, thereby realizing the purpose of controlling the air pressure within the process spaces 10.

In the first embodiment, the first perforated plate 41 further defines therein a plurality of first regulation holes 411, the second perforated plate 42 further defines therein a plurality of second regulation holes 421, and all the first regulation holes 411 and the second regulation holes 421 are oblong through holes, each of the first regulation holes 411 and each of the second regulation holes 421 are arranged in one-to-one correspondence, each of the first regulation holes 411 and the corresponding second regulation hole 421 are connected via an adjustable connection. When it is required to regulate the alignment degree between the airflow channels 401 of the first perforated plate 41 and the airflow channels 401 of the second perforated plate 42, a staff member can loosen the adjustable connection, but there is no need to dismount the connection off from the corresponding first regulation holes 411 and the corresponding second regulation holes 421, as long as the relative sliding between the first perforated plate 41 and the second perforated plate 42 can be achieved, thereafter, the first perforated plate 41 or the second perforated plate 42 is moved to change the alignment degree between airflow channels 401 of the first perforated plate 41 and the airflow channels 401 of the second perforated plate 42, so as to realize the control of the airflow in the process space 10, and after that, the adjustable connection is fastened to fix the first perforated plate 41 with the second perforated plate 42. Specifically, the adjustable connection is provided by a combination of a bolt and a nut fitting with each other. It should be understood that the adjustable connection may also adopt connecting assembly of other forms, and is not limited to the connection formed by the combination of the fitting bolt and nut.

Figure 3:
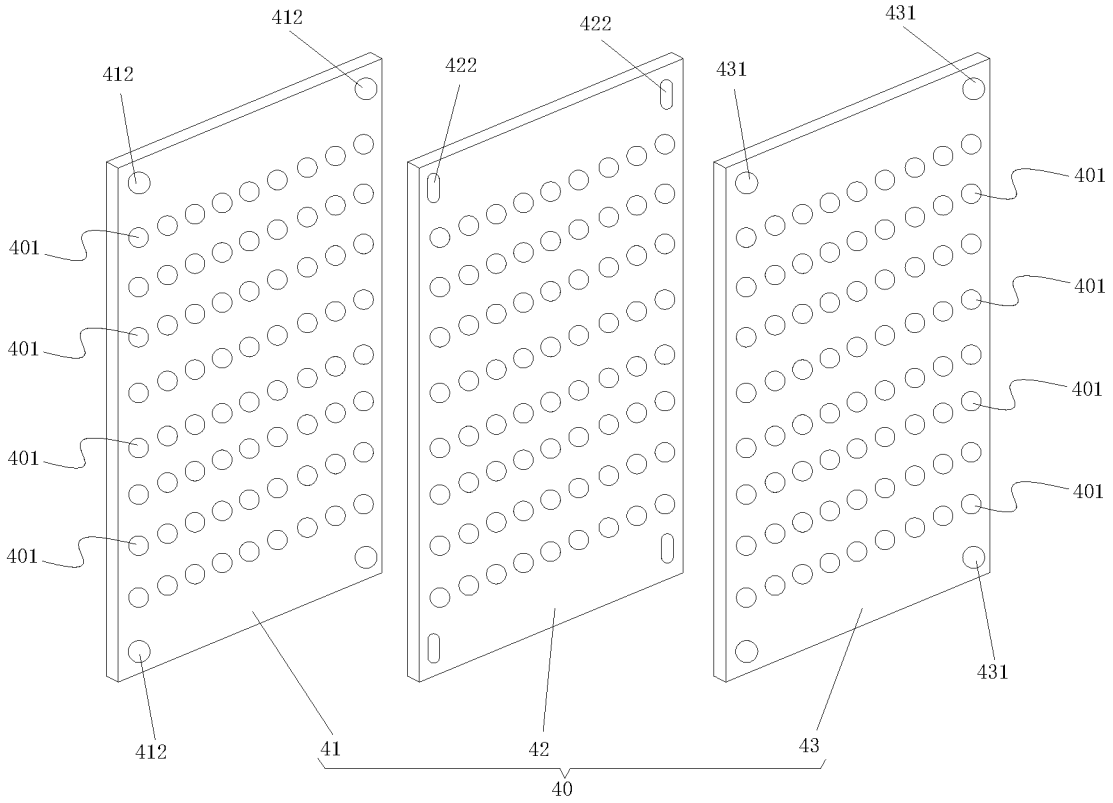
FIG. 3 is an exploded structural schematic view of an airflow regulation device of a second embodiment of the present application.

Compared with the airflow regulation device 40 formed by two perforated plates provided by the first embodiment, in a second embodiment provided by the present application, as shown in FIG. 3, the airflow regulation device 40 comprises: a first perforated plate 41, a second perforated plate 42, and a third perforated plate 43 which are sequentially stacked. The second perforated plate 42 and the first perforated plate 41 are in surface contact with each other, and the second perforated plate 42 and the third perforated plate 43 are in surface contact with each other, relative positions between the first perforated plate 41 and the third perforated plate 43 are fixed, and the second perforated plate 42 is arranged slidable relative to the first perforated plate 41 and the third perforated plate 43. All the first perforated plate 41, the second perforated plate 42, and the third perforated plate 43 define therein a plurality of airflow channels 401. The airflow channels 401 of the first perforated plate 41 and the airflow channels 401 of the third perforated plate 43 are arranged in one-to-one correspondence, one end of each of the airflow channels 401 of the second perforated plate 42 and the corresponding airflow channel 401 of the first perforated plate 41 at least partially align with each other or misalign with each other, and the other end of each of the airflow channels 401 of the second perforated plate 42 and the corresponding airflow channel 401 of the third perforated plate 43 at least partially align with each other or misalign with each other. Moreover, the first perforated plate 41 further defines therein a plurality of first perforated plate connecting holes 412, the third perforated plate 43 further defines therein a plurality of third perforated plate connecting holes 431, all the first perforated plate connecting holes 412 and the third perforated plate connecting holes 431 are circular through holes, and each of the first perforated plate connecting holes 412 is arranged to be aligned with each of the third perforated plate connecting holes 431. The second perforated plate 42 further defines therein a plurality of second perforated plate regulation holes 422, optionally, the second perforated plate regulation holes 422 are oblong through holes. A bolt is connected inside each of the second perforated plate regulation holes 422 and the corresponding first perforated plate connecting hole 412 and third perforated plate connecting hole 431, and each of the second perforated plate regulation holes 422 and the corresponding first perforated plate connecting hole 412 and third perforated plate connecting hole 431 are tightened by threaded fit of the bot with a nut. When it is required to regulate the airflow in the process space 10, the nut is loosen from the bolt by the staff member, but there is no need to dismount the blot, as long as the relative sliding of the second perforated plate 42 can be achieved, thereafter, the second perforated plate 42 is slided by the staff member to change the alignment degree among each of the airflow channels 401 of the second perforated plate 42 and the corresponding airflow channel 401 of the second perforated plate 42 and airflow channel 401 of the third perforated plate 43, so as to realize the control of the air pressure in the process space 10, and finally the regulation can be completed by only fastening the bolt and the nut together. In addition to the above differences in structure, other structures of the second embodiment are the same as those of the first embodiment and therefore would not be repeated herein.

Figure 4:
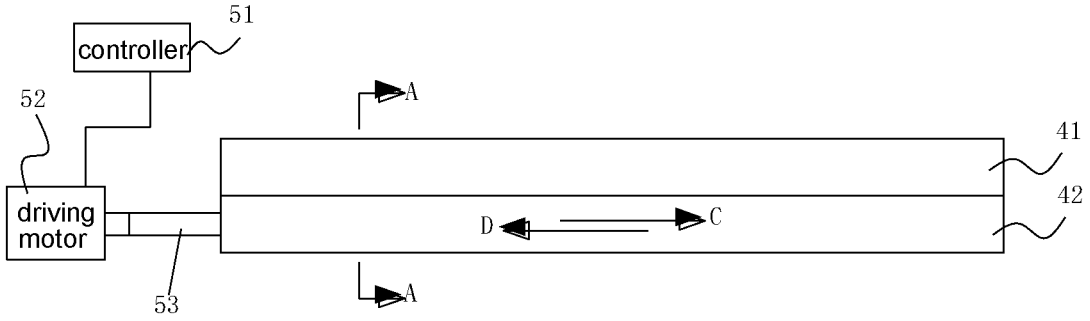
FIG. 4 is a structural schematic view of an airflow regulation device of a third embodiment of the present application.
Figure 5:
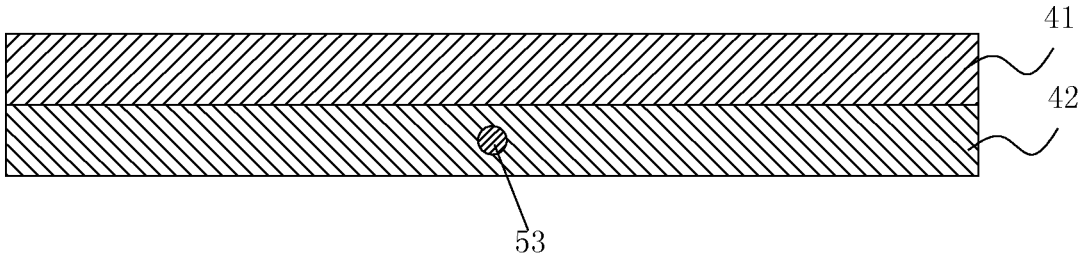
FIG. 5 is a cross-sectional structural schematic view of A-A of FIG. 4.

FIGS. 4-5 are structural schematic views of a third embodiment of the present application. As compared with the first embodiment, the third embodiment has the following differences: in the third embodiment, the first perforated plate 41 is fixed relative to the bottom of the process space 10, in this case, the first perforated plate 41 can be fixedly supported at positions on walls of the process space 10, such that a strutted space is formed between the first perforated plate 41 and the bottom of the process space 10, then the second perforated plate 42 is arranged at a lower side of the first perforated plate 41 (that is, located in the formed strutted space). Moreover, the second perforated plate 42 is arranged slidable relative to the first perforated plate 41 via the adjustable connection. Herein, the adjustable connection of the third embodiment comprises a controller 51 and a driving motor 52. The driving motor 52 is in electrical connection with the controller 51, and a driving end of the driving motor 52 is in driving connection with the second perforated plate 42. During the process of regulating the airflow regulation device 40 by the staff member, based on the manipulation of the controller 51, the operation of the driving motor 52 is controlled by the controller 51, and the second perforated plate 42 is further driven to slide relative to the first perforated plate 41. Further, the adjustable connection of the third embodiment further comprises a driving screw 53, and driving connection between the driving motor 52 and the second perforated plate 42 is achieved via the driving screw 53, that is, one end of the driving screw 53 is in driving connection with the driving end of the driving motor 52, and the other end of the driving screw 53 is in connection with the second perforated plate 42. The second perforated plate 42 defines therein a threaded hole, and the driving screw 53 is fitted inside the threaded hole. During the regulation process, the controller 51 is manipulated by the staff member such that the driving end of the driving motor 51 is controlled to drive the driving screw 53 to rotate. Because the driving screw 53 is in fitting connection with the threaded hole of the second perforated plate 42, in this way, the rotation of the driving screw 53 can be converted into a planarly sliding of the second perforated plate 42 (that is, under the drive of the driving screw 53, the second perforated plate 42 is slidable along a C direction or a D direction as indicated in FIG. 4), thereby realizing the regulation of the alignment degree between the airflow channels 401 of the first perforated plate 41 and the airflow channels 401 of the second perforated plate 42. In addition to the above differences in structure, other structures of the third embodiment are the same as those of the first embodiment and therefore would not be repeated herein.

Figure 6:
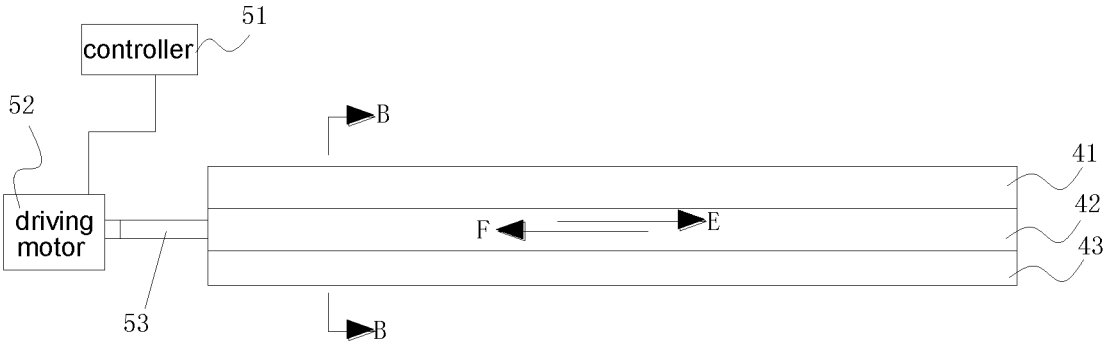
FIG. 6 is a structural schematic view of an airflow regulation device of a fourth embodiment of the present application.
Figure 7:
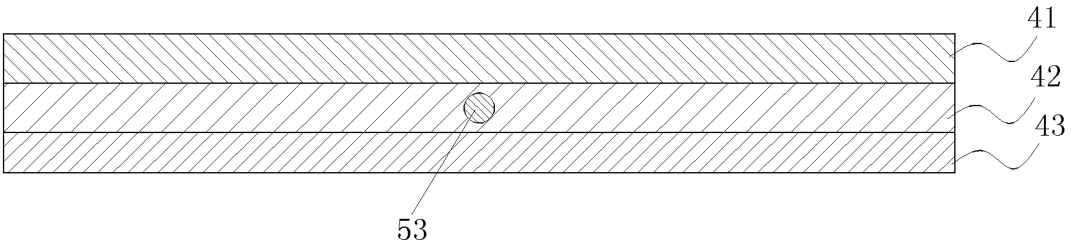
FIG. 7 is a cross-sectional structural schematic view of FIG. 6.

FIGS. 6-7 are structural schematic views of a fourth embodiment of the present application. As compared with the second embodiment, the fourth embodiment has the following differences: both the first perforated plate 41 and the third perforated plate 43 in the fourth embodiment are fixed relative to the bottom of the process space 10, in this case, the first perforated plate 41 and the third perforated plate 43 can be fixedly supported at positions on walls of the process space 10, and the second perforated plate 42 is arranged between the first perforated plate 41 and the third perforated plate 43. The second perforated plate 42 and the first perforated plate 41 are in surface contact with each other, the second perforated plate 42 and the third perforated plate 43 are in surface contact with each other, and the second perforated plate 42 is arranged slidable relative to the first perforated plate 41 and the third perforated plate 43. After the assemblage, a strutted space is formed between the third perforated plate 43 and the bottom of the process space 10. In the fourth embodiment, the adjustable connection comprises a controller 51 and a driving motor 52. The driving motor 52 is in electrical connection with the controller 51, and a driving end of the driving motor 52 is in driving connection with the second perforated plate 42. During the process of regulating the airflow regulation device 40 by the staff member, based on the manipulation of the controller 51, the operation of the driving motor 52 is controlled by the controller 51, and the second perforated plate 42 is further driven to slide relative to the first perforated plate 41 and the third perforated plate 43. Further, the adjustable connection of the fourth embodiment further comprises a driving screw 53, and driving connection between the driving motor 52 and the second perforated plate 42 is achieved via the driving screw 53, that is, one end of the driving screw 53 is in driving connection with the driving end of the driving motor 52, and the other end of the driving screw 53 is in connection with the second perforated plate 42. The second perforated plate 42 defines therein a threaded hole, and the driving screw 53 is fitted inside the threaded hole. During the regulation process, the controller 51 is manipulated by the staff member such that the driving end of the driving motor 51 is controlled to drive the driving screw 53 to rotate. Because the driving screw 53 is in fitting connection with the threaded hole of the second perforated plate 42, in this way, the rotation of the driving screw 53 can be converted into a planarly sliding of the second perforated plate 42 (that is, under the drive of the driving screw 53, the second perforated plate 42 is sliding along an E direction or an F direction as indicated in FIG. 6), thereby realizing the regulation of the alignment degree between the airflow channels 401 of the first perforated plate 41 and the airflow channels 401 of the second perforated plate 42 and the alignment degree between the airflow channels 401 of the third perforated plate 43 and the airflow channels 401 of the second perforated plate 42. In addition to the above differences in structure, other structures of the fourth embodiment are the same as those of the second embodiment and therefore would not be repeated herein.

Figure 8:
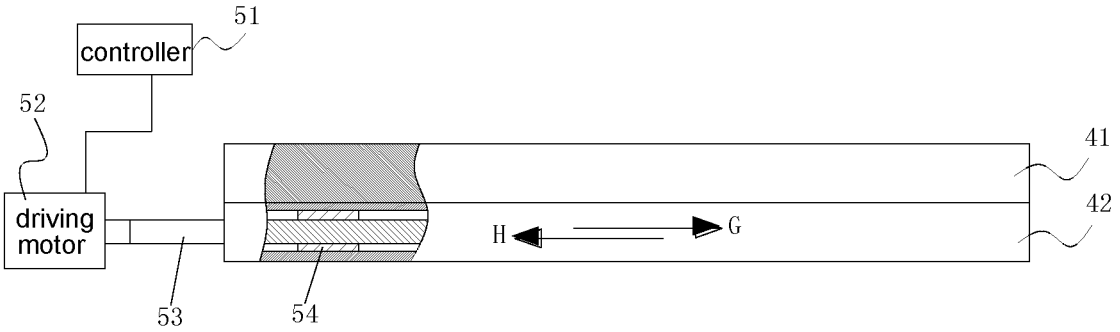
FIG. 8 is a structural schematic view of an airflow regulation device of a fourth embodiment of the present application.

FIG. 8 is a structure of a fifth embodiment of the present application, as illustrated by a structural schematic view of a partial cross section of FIG. 8, when compared with the third embodiment, the fifth embodiment has the following differences: the adjustable connection of the fifth embodiment further comprises a driving nut 54. The driving nut 54 is in fixed connection with the second perforated plate 42, one end of the driving screw 53 is in driving connection with the driving end of the driving motor 52, and the other end of the driving screw 53 extends through and fits with the driving nut 54 to form a ball screw (which is a spiral transmission member formed by a setting of a screw and a nut, with balls interposed between the screw and the nut as rolling members, and is a transmission device that has the highest accuracy and is most common in the existing transmission machinery). In the fifth embodiment, the second perforated plate 42 defines therein an accommodation hole, the driving nut 54 is fixedly arranged inside the accommodation hole, the driving screw 53 is driven by the driving motor 52 to rotate, such that the driving nut 54 is driven to linearly move thereby driving the second perforated plate 42 to slide relative to the first perforated plate 41 (that is, the second perforated plate 42 is driven by the driving screw 53 to slide relative to the first perforated plate 41 along a G direction or an H direction of FIG. 8), thereby realizing the purpose of regulating the alignment degree between the airflow channels 401 of the first perforated plate 41 and the airflow channels 401 of the second perforated plate 42. Apart from the above structure differences, other structures of the fifth embodiment are the same as those of the third embodiment and therefore would not be repeated herein.

Figure 9:
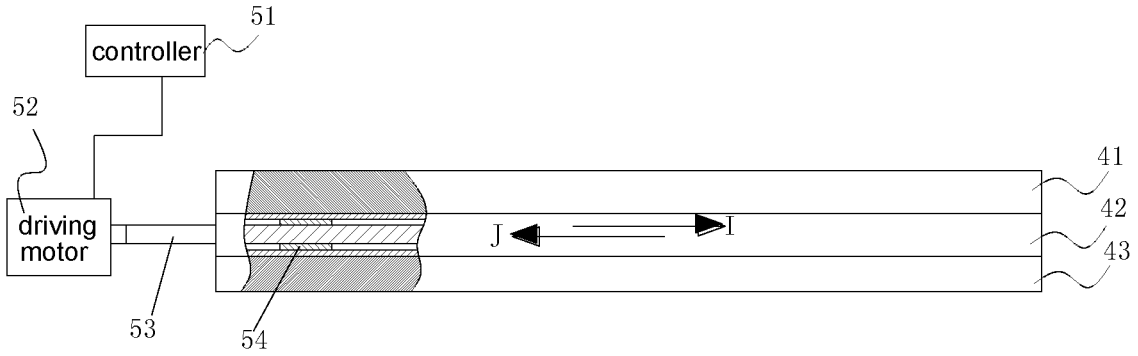
FIG. 9 is a structural schematic view of an airflow regulation device of a fourth embodiment of the present application.

FIG. 9 is a structure of a sixth embodiment of the present application. When compared with the fourth embodiment, the sixth embodiment has the following differences: the adjustable connection of the sixth embodiment further comprises a driving nut 54. The driving nut 54 is in fixed connection with the second perforated plate 42, one end of the driving screw 53 is in driving connection with the driving end of the driving motor 52, and the other end of the driving screw 53 extends through and fits with the driving nut 54 to form a ball screw. In the sixth embodiment, the second perforated plate 42 defines therein an accommodation hole, the driving nut 54 is fixedly arranged inside the accommodation hole, and then the driving screw 53 is driven by the driving motor 52 to rotate, such that the driving nut 54 is driven to linearly move thereby driving the second perforated plate 42 to slide relative to the first perforated plate 41 (that is, the second perforated plate 42 is driven by the driving screw 53 to slide relative to the first perforated plate 41 and the third perforated plate 43 along an I direction or a J direction of FIG. 9), thereby realizing the purpose of regulating the alignment degree between the airflow channels 401 of the first perforated plate 41 and the airflow channels 401 of the second perforated plate 42 and the alignment degree between the airflow channels 401 of the third perforated plate 43 and the airflow channels 401 of the second perforated plate 42. Apart from the above structure differences, other structures of the fifth embodiment are the same as those of the third embodiment and therefore would not be repeated herein.

In all the embodiments of the present application, all the perforated plates are made of stainless steel sheets (i.e., all the first perforated plate 41, the second perforated plate 42, and the third perforated plate 43 are made of stainless steel sheets). In the first embodiment, the third embodiment, and the fifth embodiment, contact surfaces between the first perforated plate 41 and the second perforated plate 42 are respectively provided with wear resistant layers (not shown), that is, a side of the first perforated plate 41 facing the second perforated plate 42 is provided with the wear resistant layer, and a side of the second perforated plate 42 facing the first perforated plate 41 is provided with the wear resistant layer. In the second embodiment, the fourth embodiment, and the sixth embodiment, contact surfaces between the first perforated plate 41 and the second perforated plate 42 are respectively provided with wear resistant layers, and contact surfaces between the second perforated plate 42 and the third perforated plate 43 are respectively provided with wear resistant layers, that is, a side of the first perforated plate 41 facing the second perforated plate 42 is provided with the wear resistant layer, and a side of the second perforated plate 42 facing the first perforated plate 41 is also provided with the wear resistant layer, a side of the third perforated plate 43 facing the second perforated plate 432 is provided with the wear resistant layer, and a side of the second perforated plate 42 facing the third perforated plate 43 is also provided with the wear resistant layer. The wear-resistant layer is configured to improve the wear resistant life of each contact surface, and the wear resistant layer has a self-lubricating function, thus being capable of reducing the friction between the contact surfaces.

According to another aspect of the present application, a method for regulating an airflow of a clean room is provided. Specifically, the method for regulating the airflow can be performed by a staff member in the clean room, and the method for regulating the airflow comprises the following steps:

starting the fan filter units 20 of a clean room for supplying air; and controlling the airflow into the process spaces 10 of the clean room by regulating the airflow regulation devices 40 of the clean room.

Specifically, the airflow regulation device 40 comprises a plurality of perforated plates being stacked with one another (herein, the air regulating device 40 formed by the first perforated plate 41 and the second perforated plate 42 as provided in the above-described clean room can be selected, or alternatively, the air regulating device 40 formed by the first perforated plate 41, the second perforated plate 42, and the third perforated plate 43 as provided in the above-described clean room can be selected, therefore the method for regulating the alignment degree between the airflow channels 401 of the perforated plates is also the same as the regulating method as described in the above and would not be repeated herein). Each perforated plate defines therein a plurality of airflow channels 401, before the step of controlling the airflow into the process spaces 10 of the clean room by regulating the airflow regulation devices 40 of the clean room, the flow rate of the airflow within the process space 10 is controlled by regulating the airflow channels 401 of different perforated plates in one-to-one correspondence to partially align or misalign with each other.

EXPLANATION

Fan filter unit, short for FFU, can be used in modular connection. FFU is widely applied in application occasions such as clean room, clean workbench, clean production line, assembled clean room, and regional class 100. The fan filter unit has a two-stage filter screen with a preliminary efficiency and a high efficiency, air is sucked in by a top fan and filtered by the filter screens of preliminary efficiency and high efficiency, the clean air after filter is blown out from an entire air outlet surface at a flow rate of 0.45 m/s±20%.

The above is only the optional embodiment of the present application, and is not intended to limit the application. Any modifications, equivalent substitutions, and improvements made within the spirit and principles of the present application are included in the protection scope of the present application.

What is claimed is:

1. A clean room, comprising:

a plurality of process spaces in communication with one another, and a fan filter unit, installed at a top of each one of the plurality of process spaces, and a bottom of each of the plurality of process spaces is provided with a ventilation passage;

wherein, the clean room further comprises:

an airflow regulation device, configured to regulate an airflow in each of the process spaces; and wherein the airflow regulation device is installed inside each of the plurality of process spaces, and is arranged downstream of the respective fan filter unit;

the airflow regulation device comprises a first perforated plate and a second perforated plate;

the first perforated plate and the second perforated plate are stacked with each other, and the first perforated plate and the second perforated plate are in surface contact with each other;

the first perforated plate and the second perforated plate respectively define therein airflow channels, when the first perforated plate and the second perforated plate are stacked with each other, the airflow channels of the first perforated plate and the airflow channels of the second perforated plate at least partially align or misalign with each other; and contact surfaces between the first perforated plate and the second perforated plate are respectively provided with wear resistant layers.

2. The clean room of claim 1, wherein each airflow regulation device is installed at the bottom of each process space above the ventilation passage.

3. The clean room of claim 1, wherein an airflow exchange passage is arranged between two adjacent process spaces; the airflow regulation device is installed close to the bottom of the respective process space, and the airflow regulation device is arranged between the ventilation passage and the airflow exchange passage.

4. The clean room of claim 2, wherein a distance between the airflow regulation device and a bottom surface of the respective process space is H, and 20 cm≤H≤35 cm.

5. The clean room of claim 1, wherein the first perforated plate further defines therein a plurality of first regulation holes, the second perforated plate further defines therein a plurality of second regulation holes, each of the first regulation holes and each of the second regulation holes are arranged in one-to-one correspondence, and each of the first regulation holes and the corresponding second regulation hole are connected via an adjustable connection.

6. The clean room of claim 5, wherein the adjustable connection is provided by a combination of a bolt and a nut fitting with each other.

7. The clean room of claim 5, wherein the first perforated plate is fixed relative to the bottom of each process space;

the second perforated plate is arranged slidable relative to the first perforated plate via the adjustable connection; and the adjustable connection comprises:

a controller, and a driving motor, wherein a driving end of the driving motor is in driving connection with the second perforated plate, and the driving motor is in electrical connection with the controller.

8. The clean room of claim 7, wherein the adjustable connection further comprises a driving screw;

one end of the driving screw is in driving connection with the driving end of the driving motor, and the other end of the driving screw is in connection with the second perforated plate; wherein the second perforated plate defines therein a threaded hole, and the driving screw is fitted inside the threaded hole.

9. The clean room of claim 7, wherein the adjustable connection further comprises a driving screw and a driving nut; the driving nut is in fixed connection with the second perforated plate, one end of the driving screw is in driving connection with the driving end of the driving motor, and the other end of the driving screw extends through and fits with the driving nut.

10. The clean room of claim 9, wherein balls are disposed between the driving screw and the driving nut to form a ball screw.

11. The clean room of claim 1, wherein the airflow regulation device further comprises a third perforated plate, the first perforated plate, the second perforated plate, and the third perforated plate are sequentially stacked; the second perforated plate and the third perforated plate are in surface contact with each other;

the third perforated plate defines therein a plurality of airflow channels;

the airflow channels of the first perforated plate and the airflow channels of the third perforated plate are arranged in one-to-one correspondence, one end of each of the airflow channels of the second perforated plate and the corresponding airflow channel of the first perforated plate at least partially align with each other or misalign with each other, and the other end of each of the airflow channels of the second perforated plate and the corresponding airflow channel of the third perforated plate at least partially align with each other or misalign with each other.

12. The clean room of claim 11, wherein the first perforated plate further defines therein a plurality of first perforated plate connecting holes, the third perforated plate further defines therein a plurality of third perforated plate connecting holes; each of the first perforated plate connecting holes is arranged to be aligned with each of the third perforated plate connecting holes;

the second perforated plate further defines therein a plurality of second perforated plate regulation holes;

a bolt is connected inside each of the second perforated plate regulation holes and a corresponding first perforated plate connecting hole and third perforated plate connecting hole, and each of the second perforated plate regulation holes and the corresponding first perforated plate connecting hole and third perforated plate connecting hole are tightened by threaded fit of the bot with a nut.

13. The clean room of claim 11, wherein both the first perforated plate and the third perforated plate are fixed relative to the bottom of the process space;

the second perforated plate is arranged to be slidable relative to the first perforated plate and the third perforated plate via the adjustable connection;

the adjustable connection comprises: a controller and a driving motor; wherein a driving end of the driving motor is in driving connection with the second perforated plate, and the driving motor is in electrical connection with the controller.

14. The clean room of claim 13, wherein the adjustable connection further comprises a driving screw;

one end of the driving screw is in driving connection with the driving end of the driving motor, and the other end of the driving screw is in connection with the second perforated plate; the second perforated plate defines therein a threaded hole, and the driving screw is fitted inside the threaded hole.

15. The clean room of claim 11, wherein contact surfaces between the second perforated plate and the third perforated plate are provided with wear resistant layers.

16. A method for regulating an airflow of a clean room, the method being performed in the clean room according to claim 1, and the method comprising the following steps:

powering on the fan filter unit of the respective clean room for supplying air; and controlling the airflow into the process spaces of the clean room by regulation of the airflow regulation device of the respective clean room.

17. The method for regulating the airflow of the clean room of claim 16, wherein the airflow regulation device comprises a plurality of perforated plates being stacked with one another; each perforated plate defines therein a plurality of airflow channels; and in the step of controlling the airflow into the process spaces of the clean room by regulation of the airflow regulation device of the respective clean room, a flow rate of the airflow within the respective process space is controlled by regulating the airflow channels of different perforated plates in one-to-one correspondence to partially align or misalign with each other.

* * * * *